US009339137B2

(12) United States Patent
Nelson

(10) Patent No.: US 9,339,137 B2
(45) Date of Patent: May 17, 2016

(54) HOLDING TOOL

(71) Applicant: Wade Nelson, Moses Lake, WI (US)

(72) Inventor: Wade Nelson, Moses Lake, WI (US)

( * ) Notice: Subject to any disclaimer, the term of this patent is extended or adjusted under 35 U.S.C. 154(b) by 0 days.

(21) Appl. No.: 14/133,878

(22) Filed: Dec. 19, 2013

(65) Prior Publication Data

US 2015/0173547 A1 Jun. 25, 2015

(51) Int. Cl.

| | |
|---|---|
| ***A47G 29/08*** | (2006.01) |
| ***A44B 15/00*** | (2006.01) |
| ***A47G 29/087*** | (2006.01) |

(52) U.S. Cl.

CPC ..... *A47G 29/08* (2013.01); *A44B 15/00* (2013.01); *A47G 29/087* (2013.01)

(58) Field of Classification Search

CPC ..... Y10S 52/04; Y10S 428/90; A47G 29/08; A47G 29/10; A47K 10/04; A47F 7/00; A47F 5/0807; B42D 17/00; B42F 15/066; G09F 1/10

See application file for complete search history.

(56) References Cited

U.S. PATENT DOCUMENTS

| | | | | |
|---|---|---|---|---|
| 3,126,190 | A * | 3/1964 | Miller | 248/206.5 |
| 3,350,045 | A * | 10/1967 | Mayers | 248/205.3 |
| 3,408,771 | A * | 11/1968 | Garrett et al. | 49/34 |
| 4,830,322 | A * | 5/1989 | Gary | 248/206.5 |
| 5,407,158 | A | 4/1995 | Baird | |
| 5,699,910 | A * | 12/1997 | Kubat | 206/373 |
| 5,740,995 | A | 4/1998 | Richter | |
| 5,860,824 | A | 1/1999 | Fan | |
| 6,036,071 | A | 3/2000 | Hartmann et al. | |
| 7,946,246 | B2 * | 5/2011 | Silverman | 118/500 |
| 2002/0088909 | A1 * | 7/2002 | Chen | 248/251 |
| 2005/0247835 | A1 * | 11/2005 | Cale | 248/206.5 |
| 2010/0072147 | A1 * | 3/2010 | Reenberg et al. | 211/45 |
| 2010/0116955 | A1 * | 5/2010 | Hayes et al. | 248/206.5 |
| 2010/0163696 | A1 * | 7/2010 | Briggs et al. | 248/206.5 |
| 2011/0001025 | A1 * | 1/2011 | Fiedler | A45C 13/1069 248/206.5 |

FOREIGN PATENT DOCUMENTS

| | | | |
|---|---|---|---|
| EP | 2775692 | A1 * | 3/2013 |

* cited by examiner

*Primary Examiner* — Jeanette E Chapman
(74) *Attorney, Agent, or Firm* — Dale J. Ream

(57) ABSTRACT

A holding apparatus for use in selectively securing an article includes a shaft having opposed first and second ends and a generally linear configuration. A first mounting member is attached to the first end of the shaft, the first mounting member including a magnet configured to attach to one of another magnet or metal surface. A second mounting member is attached to the second end of the shaft. In some embodiments, the second mounting member includes a magnet such that the apparatus may be selectively attached to a metal object. In another embodiment, the second mounting member may include a bore through the shaft configured to selectively receive a key ring.

4 Claims, 6 Drawing Sheets

HOLDING TOOL

BACKGROUND OF THE INVENTION

This invention relates generally to article holding devices and, more particularly, to a holding apparatus having one end removably attachable to a magnetic surface of an automobile, refrigerator, or the like and another end for holding an article.

Small items such as keys, cigarette lighters, pens, small pen-sized flashlights, or the like are often difficult to keep track of—especially within the confines of an automobile. Various holding devices, such as bins, boxes, cups, manila folders, and the like have been used to hold or store small items so as to keep them easily accessible and available when needed within an automobile. A similar problem may occur within the often cluttered confines of a kitchen.

Various devices have been proposed in the art for holding small articles. Although assumably effective for their intended purposes, these devices or proposals are still insufficient. Namely, an article such as a key ring or a cigarette lighter is not immediately available for use if it must first be sorted out from among other objects that may be stored in a bin, box, cup, etc. positioned within the interior of an automobile.

Therefore, it would be desirable to have a holding device that may itself be attached to a metallic surface within an automobile's interior and that effectively holds articles out of the way but immediately accessible when needed. Further, it would be desirable to have a holding device having magnetic holding members at opposite ends of a shaft so as to be coupled to any magnetically attractable surface and to which metallic articles may be attached.

SUMMARY OF THE INVENTION

A holding apparatus for use in selectively securing an article according to the present invention includes a shaft having opposed first and second ends and a generally linear configuration. A first mounting member is attached to the first end of the shaft, the first mounting member including a magnet configured to attach to one of another magnet or metal surface. A second mounting member is attached to the second end of the shaft. In some embodiments, the second mounting member includes a magnet such that the apparatus may be selectively attached to a metal object. In another embodiment, the second mounting member may include a bore through the shaft configured to selectively receive a key ring.

Therefore, a general object of this invention is to provide a holding apparatus that is readily attachable and detachable from a metallic or magnetic surface.

Another object of this invention is to provide a holding apparatus, as aforesaid, having a first end that may be attached to a metallic surface within an automobile's interior and another end to which another item may be attached and, consequently, immediately accessible when needed.

Still another object of this invention is to provide a holding apparatus, as aforesaid, that is portable and repositionable for use wherever needed to hold an object that needs to be readily accessible, such as a cigarette lighter, key ring, or the like.

Yet another object of this invention is to provide a holding apparatus, as aforesaid, that has a magnet at one or both opposed ends capable of selectively coupling to a metallic or magnetic surface.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
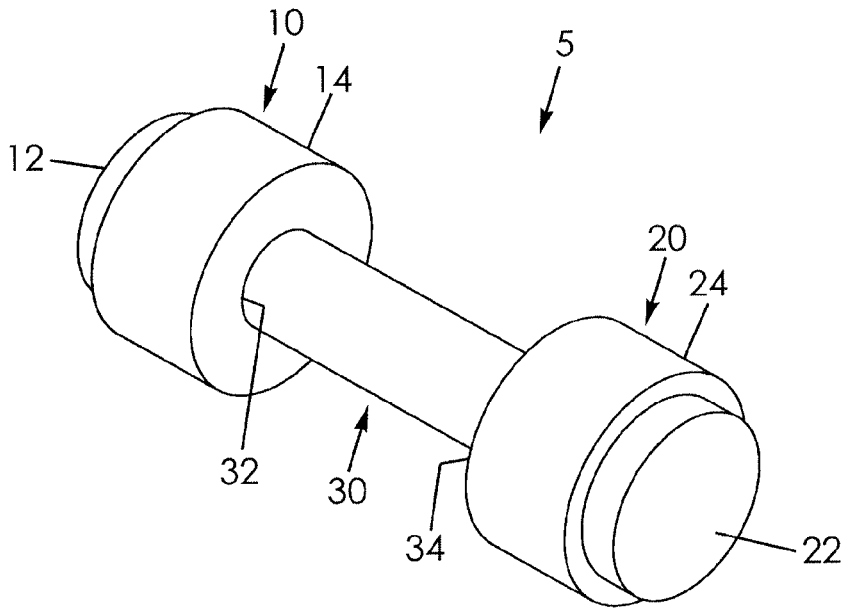
FIG. 1 is a perspective view of a holding apparatus according to an embodiment of the present invention.

A holding apparatus according to a preferred embodiment of the present invention will now be described in detail with reference to FIGS. 1 to 6 of the accompanying drawings. The holding apparatus 5 includes a first mounting member 10, a second mounting member 20, and a shaft 30 having opposed first 32 and second 34 ends.

The first end 32 of the shaft 30 is coupled to the first mounting member 10. The first mounting member 10 includes a first magnet 12. The first magnet 12 is configured to attach to one of another magnet or metal surface. The first mounting member 10 may also include a first housing 14. The first magnet 12 may be positioned within the first housing 14.

Figure 4A:
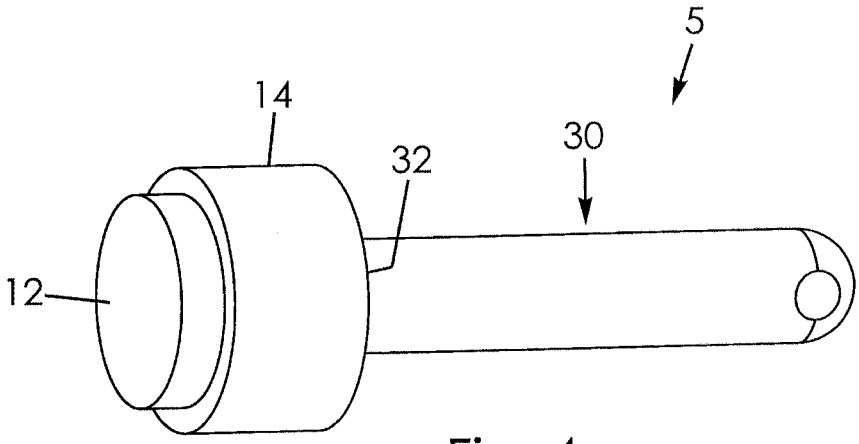
FIG. 4*a* is a perspective view of the holding apparatus according to another embodiment of the present invention.
Figure 4B:
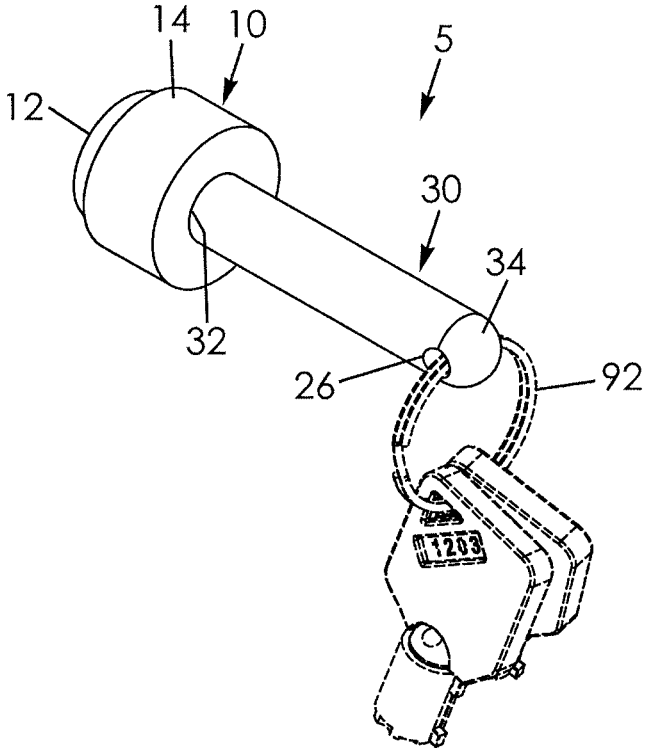
FIG. 4*b* is a perspective view of the holding apparatus as in FIG. 4*a* in use in securing a key ring.

The second end 34 of the shaft 30 is coupled to the second mounting member 20. In one embodiment, the second mounting member 20 is a bore 26 through the second end 34 of the shaft 30. The bore 26 may be configured to receive a key ring 92 (FIG. 4*b*). In another embodiment, the second mounting member 20 includes a second magnet 22. The second magnet 22 is configured to attach to one of another magnet or metal object 94 such as a cigarette lighter or similar metal object. The second mounting member 20 may also include a second housing 24. The second magnet 22 may be positioned within the second housing 24.

Figure 3A:
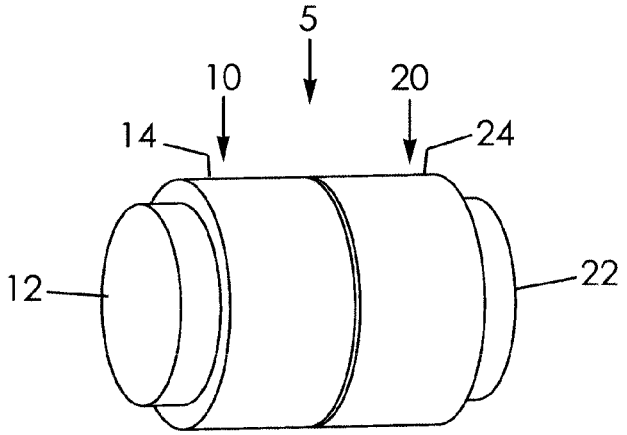
FIG. 3*a* is another perspective view of the holding apparatus according to another embodiment of the present invention.
Figure 3B:
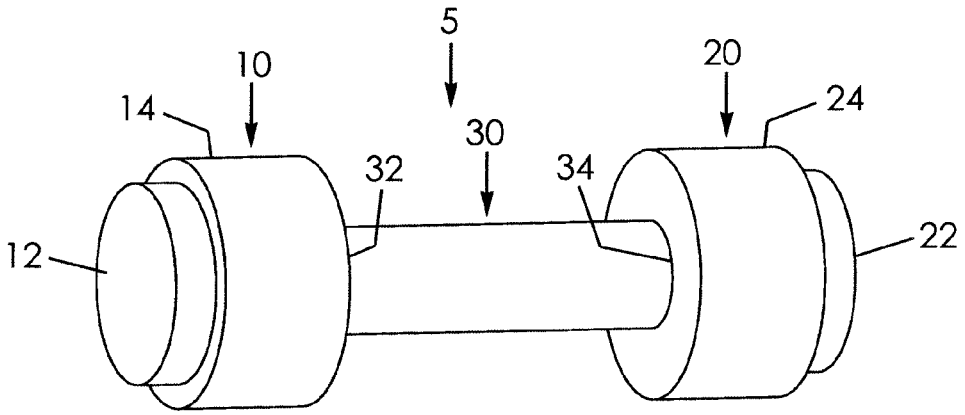
FIG. 3*b* is a perspective view of the holding apparatus as in FIG. 1.

The shaft 30 may have a generally linear configuration. In one embodiment, the shaft 30 includes an elongate length such that the second mounting member 20 is displaced from the first mounting member 10 (FIG. 3*b*). In another embodiment, the shaft 30 includes a truncated length such that the second mounting member 20 is adjacent the first mounting member 10 (FIG. 3*a*).

Figure 2:
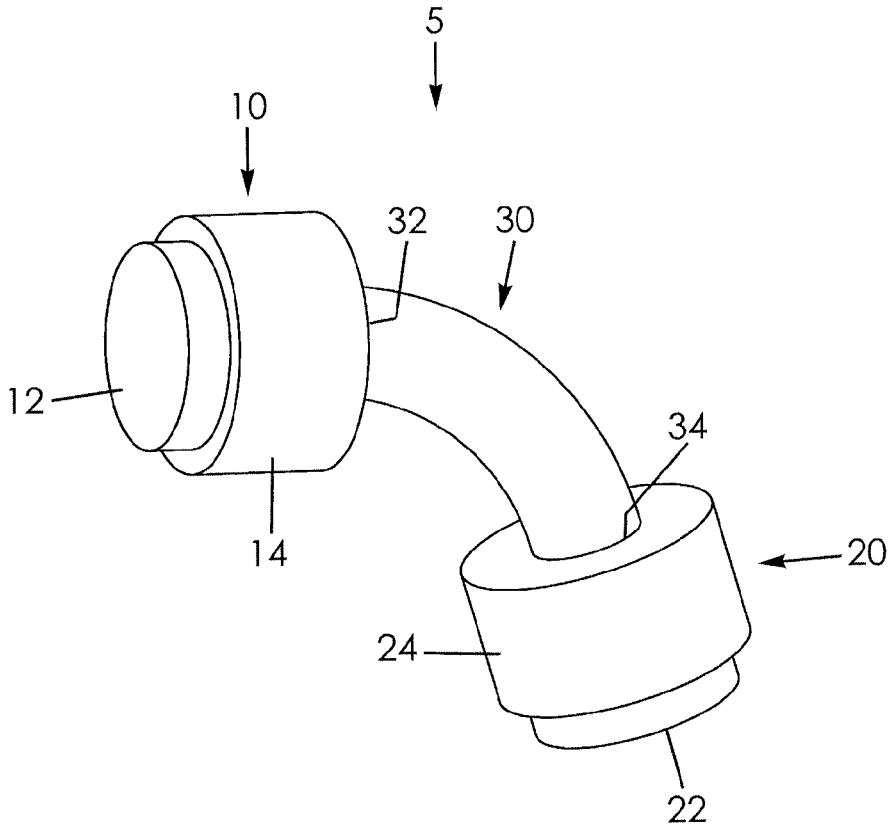
FIG. 2 is another perspective view of the holding apparatus according to another embodiment of the present invention.

In one embodiment, the shaft 30 is constructed of a flexible and resilient material that is movable from a released configuration to a loaded configuration (FIG. 2). The shaft 30 may be normally biased towards the released configuration. In the released configuration, the shaft 30 may have a generally linear configuration. In the loaded configuration, the shaft 30 may have a generally curved configuration.

In another embodiment (FIG. 5*b*), the shaft 30 may include a first section 40 having opposed proximal 42 and distal 44 ends and a second section 50 having opposed proximal 52 and distal 54 ends. The proximal end 42 of the first section 40 of the shaft 30 may be coupled to the first mounting member 10. The proximal end 52 of the second section 50 may be coupled to the second mounting member 20. Consequently, the proximal end 42 of the first section 40 of the shaft 30 may be equivalent to the first end 32 of the shaft 30 and the proximal end 52 of the second section 50 of the shaft 30 may be equivalent to the second end 34 of the shaft as first described previously.

The first section 40 of the shaft 30 may be pivotally coupled to the second section 50 of the shaft 30 such that the second mounting member 20 is movable between a first configuration and a second configuration. In the first configuration, the second mounting member 20 may be in linear alignment with the first mounting member 10. In the second configuration, the second mounting member 20 may be offset relative to the first mounting member 10 (FIG. 5*b*).

Figure 5A:
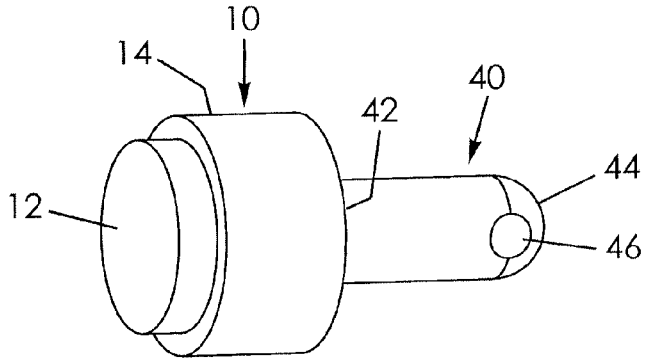
FIG. 5*a* is a perspective view of a first section of the holding apparatus according to another embodiment of the present invention.
Figure 5B:
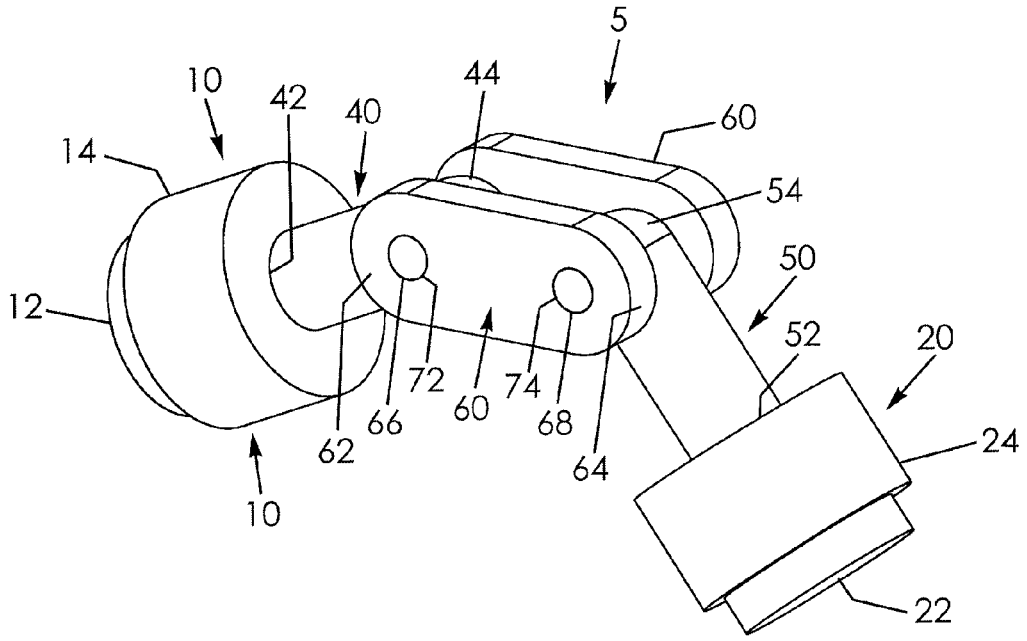
FIG. 5*b* is another perspective view of the holding apparatus according to another embodiment of the present invention.
Figure 6:
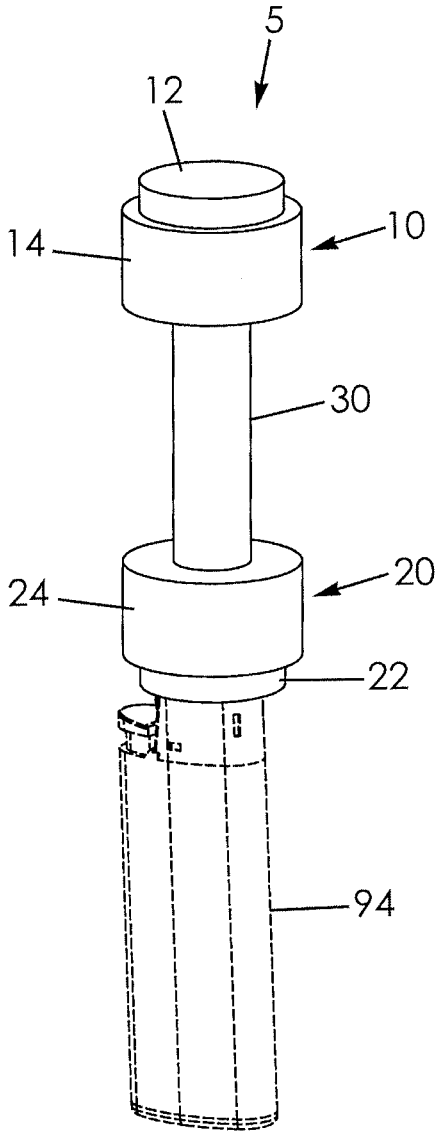
FIG. 6 is a perspective view of the holding apparatus as in FIG. 1 in use in securing a cigarette lighter.

More particularly, the holding apparatus 5 shown in FIG. 5*b* may also include at least one plate member 60 having opposed first 62 and second 64 ends. The plate member 60 defines a first aperture 66 at the first end 62 of the plate member 60 and a second aperture 68 at the second end 64 of the plate member. The distal end 44 of the first section 40 of the shaft 30 may define a fastener hole 46. A first fastener 72 may be in communication with the first aperture 66 of the plate member 60 and the fastener hole 46 of the first section 40 of the shaft 30 so as to pivotally couple the plate member 60 to the first section 40 of the shaft 30.

The distal end 52 of the second section 50 of the shaft 30 may define a fastener hole (not shown). A second fastener 74 may be in communication with the second aperture 68 of the plate member 60 and the fastener hole (not shown) of the second section 50 of the shaft 30 so as to pivotally couple the plate member 60 to the second section 50 of the shaft 30.

The holding apparatus 5 may include more than one plate member 60. Each plate member 60 may be coupled to the first section 40 of the shaft 30 with the first fastener 72 such that the first section 40 of the shaft 30 is pivotally coupled to the plate members 60. Each plate member 60 may also be coupled to the second section 50 of the shaft 30 with the second fastener 74 such that the second section 50 of the shaft 30 is pivotally coupled to the plate members 60. The second section 50 of the shaft 30 may be displaced from the first section 40 of the shaft. It is understood that the structure described above and shown in FIG. 5*b* enables the holding apparatus 5 to be selectively oriented as needed and desired by a user for maximum flexibility and utility.

In use, an object such as a key ring 92 or a cigarette lighter 94 may be selectively coupled to the second mounting member 20 of the holding apparatus 5. The first mounting member 10 of the holding apparatus 5 may then be selectively coupled to a magnet or a metal surface so that the object may be held out of the way but remain immediately accessible when needed.

It is understood that while certain forms of this invention have been illustrated and described, it is not limited thereto except insofar as such limitations are included in the following claims and allowable functional equivalents thereof.

The invention claimed is:

1. A holding apparatus for use in selectively securing an article, comprising:

a shaft having opposed first and second ends;

wherein said shaft includes a first section having a generally linear configuration said first section being pivotally coupled to a second section having a generally linear configuration;

wherein said distal end of said first section is a free end and said distal end of said second section is a free end such that said first section is independently constructed apart from said second section;

a first mounting member attached to said proximal end of said first section of said shaft, said first mounting member including a first housing and a first magnet positioned within said first housing, said first magnet being configured to attach to one of another magnet or metal surface;

a second mounting member attached to said second end of said shaft;

wherein said second mounting member is pivotally movable between a first configuration in linear alignment with said first mounting member and a second configuration offset relative to said first mounting member;

a pair of parallel plate members, each plate member being pivotally coupled at one end to said distal end of said first section of said shaft with a first fastener and being pivotally coupled at another end to said distal end of said second section of said shaft with a second fastener such that said first section and said second section are movable between an aligned configuration sharing a common linear axis and a displaced configuration pivotally offset relative to the other.

2. The holding apparatus as in claim 1, wherein said second mounting member includes a second housing and a second magnet positioned within said second housing, said second magnet being configured to selectively attach to one of another magnet or metal object.

3. The holding apparatus as in claim 1, wherein said shaft includes an elongate length such that said second mounting member is displaced from said first mounting member.

4. The holding apparatus as in claim 1, wherein said shaft is constructed of a flexible and resilient material that is movable from a generally linear configuration to a generally curved configuration, said shaft being normally biased toward said linear configuration.

* * * * *